United States Patent [19]

Lauchner

[11] Patent Number: 4,476,447

[45] Date of Patent: Oct. 9, 1984

[54] ADJUSTABLE DIRECTIONAL COUPLER AND POWER DETECTOR UTILIZING SAME

[75] Inventor: John K. Lauchner, Tempe, Ariz.

[73] Assignee: Motorola, Inc., Schaumburg, Ill.

[21] Appl. No.: 415,092

[22] Filed: Sep. 7, 1982

[51] Int. Cl.[3] ..... H01P 5/04

[52] U.S. Cl. ..... 333/111; 333/116; 324/95

[58] Field of Search ..... 333/111, 116, 109, 161, 333/139; 324/95

[56] References Cited

U.S. PATENT DOCUMENTS

| | | | |
|---|---|---|---|
| 2,898,559 | 8/1959 | Heinard et al. | 333/111 |
| 3,005,168 | 10/1961 | Fye | 333/161 |
| 3,166,723 | 1/1965 | Beck et al. . | |
| 3,316,509 | 4/1967 | Ayer et al. | 333/161 |
| 4,349,793 | 9/1982 | Spinner | 333/111 |

FOREIGN PATENT DOCUMENTS

| | | | |
|---|---|---|---|
| 2364018 | 7/1975 | Fed. Rep. of Germany . | |
| 233788 | 5/1969 | U.S.S.R. | 324/95 |
| 681391 | 8/1979 | U.S.S.R. | 324/95 |

*Primary Examiner*—Paul L. Gensler
*Assistant Examiner*—Benny Lee
*Attorney, Agent, or Firm*—Jonathan P. Meyer

[57] ABSTRACT

A compact power detector apparatus comprises a unique adjustable directional coupler and a power detector circuit integrated therewith. The adjustable coupler comprises a pair of stripline conductors, one of which is carried on a turntable. The coupling distance between the conductors varies as the turntable rotates. The power detector circuit is also carried on the turntable, thus avoiding the need for flexible interconnections. The output from the detector circuit is taken from a connector substantially in the center of the turntable.

18 Claims, 4 Drawing Figures

ADJUSTABLE DIRECTIONAL COUPLER AND POWER DETECTOR UTILIZING SAME

FIELD OF THE INVENTION

The present invention relates, in general, to adjustable directional couplers for use with microwave transmission lines and the like. More particularly, the invention relates to a rotary, continuously variable stripline directional coupler and a compact power detector apparatus utilizing such a coupler.

BACKGROUND OF THE INVENTION

Adjustable directional couplers are well known in the art for providing variable electromagnetic coupling between two transmission lines. In general, a mechanical motion of one or both of the conductors between which coupling occurs accomplishes the desired variation. However, the requirement that a portion of a transmission line be moveable may cause electrical instabilities and require physical bulk which are undesirable. In addition, prior art adjustable couplers are not readily integratible with a circuit which utilizes the coupled signal. For instance, it may be desired to variably sample a signal on a primary transmission line, to input the sampled signal into a circuit such as a power detector circuit and to output the resulting signal for various timing or other control purposes. This function is particularly difficult to achieve in space-limited devices such as fuzes and the like.

SUMMARY OF THE INVENTION

Accordingly, it is an object of the present invention to provide an improved adjustable directional coupler.

It is a further object of the present invention to provide a compact, integrated adjustable directional coupler and power detector circuit or the like.

A particular embodiment of the present invention comprises a compact, integrated power detector apparatus for sampling and detecting a signal carried on a primary transmission line. The apparatus is connected in series with the primary transmission line by means of a pair of standard connectors and a first stripline circuit. The stripline circuit comprises a pair of dielectric sheets with ground planes disposed on their outer sides and a first stripline conductor sandwiched between them. The first stripline conductor passes adjacent to a turntable portion of one of the dielectric sheets. The turntable is adapted to rotate with respect to the remainder of the apparatus. A second stripline conductor is carried on the turntable and has a coupling portion which is juxtaposed with the first stripline conductor and is adapted to vary a coupling distance therebetween as the turntable rotates. A power detector circuit comprising a detector diode and a transistor buffer is also carried on the turntable and is connected to the second stripline circuit and to an output connector located substantially in the center of the turntable. Adjustment of the electromagnetic coupling between the first and second stripline conductors is accomplished by a simple rotary motion which is reliable and provides for a compact package. In addition, the detection circuit is carried with the moveable portion of the coupler, thus requiring no mechanical joints in the circuit. This adjustable coupler concept is applicable to a wide range of applications besides adjustable power detectors.

These and other objects and advantages of the present invention will be apparent to one skilled in the art from the detailed description below taken together with the drawings.

DETAILED DESCRIPTION OF THE INVENTION

Figure 1:
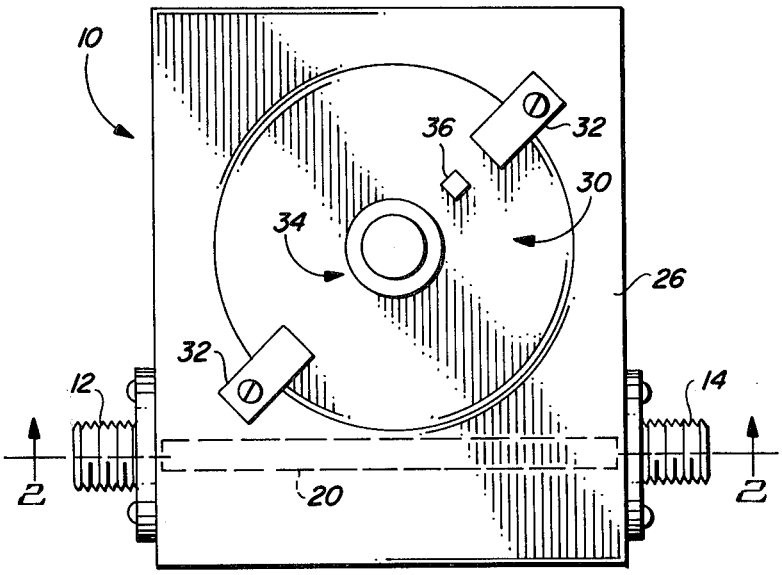
FIG. 1 is a top plan view of an adjustable stripline power detector apparatus according to the principles of the present invention.
Figure 2:
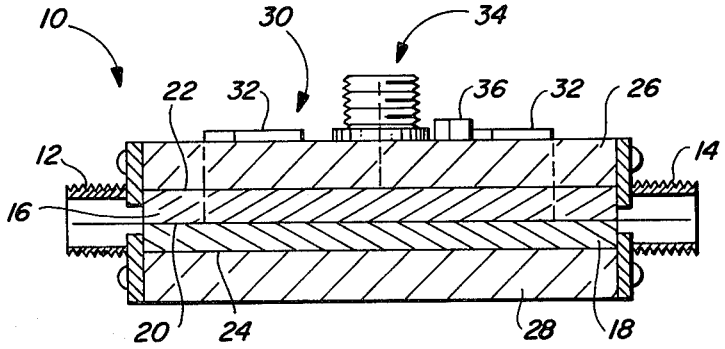
FIG. 2 is a cross sectional view of the apparatus of FIG. 1 along the line 2—2.

Referring to FIGS. 1 and 2 an adjustable stripline power detector apparatus 10 is shown in top plan and cross sectional views, respectively. Apparatus 10 is connected in series with a primary transmission line (not shown here) by means of connectors 12 and 14. In this case, apparatus 10 is intended for use with coaxial cable and coaxial connectors 12 and 14; however, the scope of the present invention is not so limited. A first stripline circuit comprises a first dielectric sheet 16, a second dielectric sheet 18, a stripline conductor 20 disposed between dielectric sheets 16 and 18 and first and second ground planes 22 and 24 disposed on the opposite sides of dielectric sheets 16 and 18, respectively. As is familiar in the art, stripline circuits are customarily fabricated by depositing a layer of metal on both sides of a dielectric sheet, masking the desired pattern of conductors on one side thereof and removing the unmasked metal from that side, leaving a ground plane on one side of the sheet and the desired conductors on the other. A first metal plate 26 and a second metal plate 28, in contact with ground planes 22 and 24, respectively, provide structural integrity of the apparatus. Stripline conductor 20 is connected by means of connectors 12 and 14 to the central conductor of the primary transmission line.

A turntable portion 30 of apparatus 10 comprises corresponding rotatable portions of first metal plate 26, first ground plane 22 and first dielectric sheet 16 which are held in place by brackets 32. An output connector 34, which can be of the same type as connectors 12 and 14, is located substantially in the center of turntable portion 30. In addition, a filter feedthrough connector 36 is located on turntable portion 30. The function of connectors 34 and 36 will be understood in connection with the description of FIG. 3 below.

Figure 3:
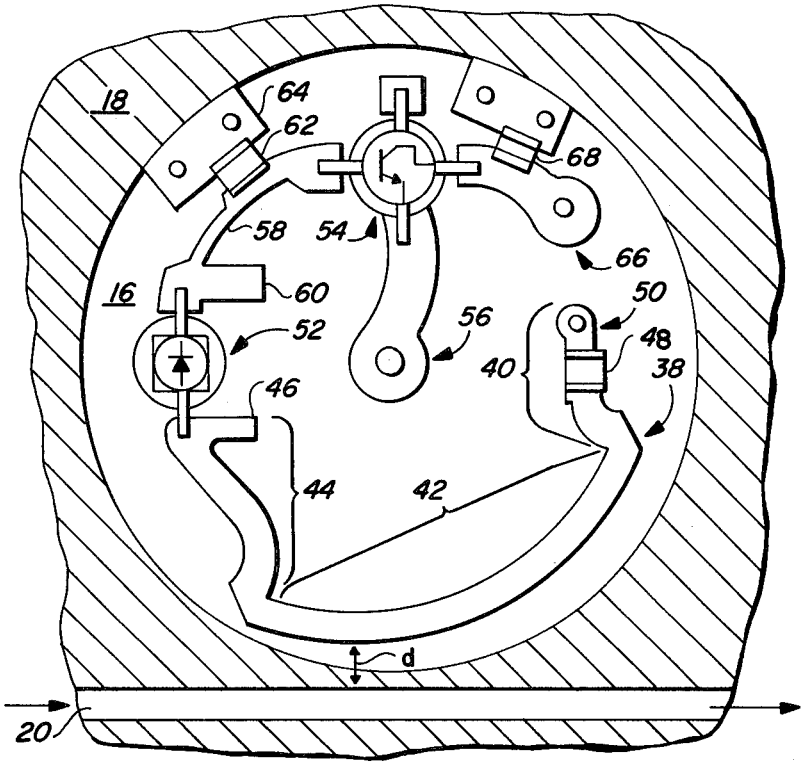
FIG. 3 is a top plan view of the stripline circuits of the apparatus of FIGS. 1 and 2 on an enlarged scale.
Figure 4:
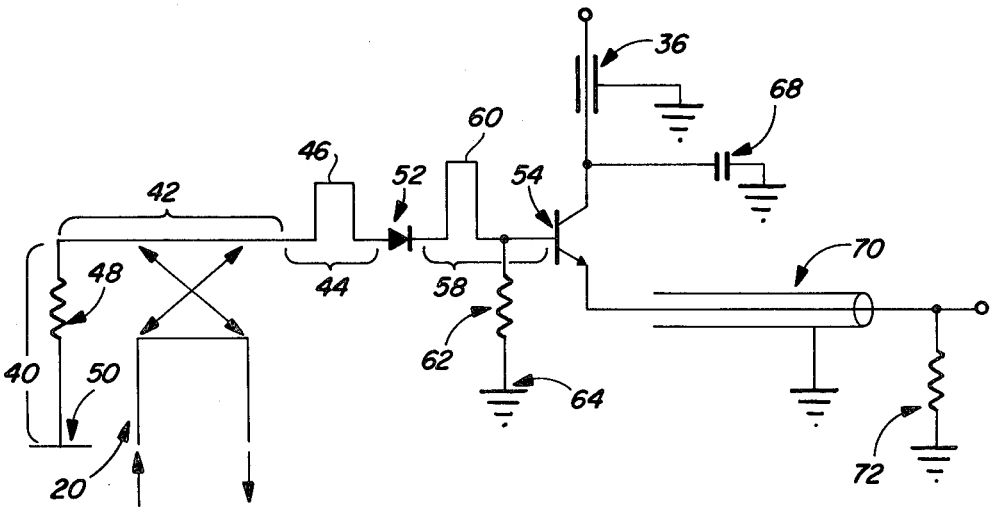
FIG. 4 is a schematic diagram of the circuits of FIG. 2.

Referring now to FIGS. 3 and 4, the circuits of apparatus 10 are shown in plan and schematic views, respectively. FIG. 3 corresponds to the perspective of FIG. 1 and is drawn as if every component of the apparatus were transparent except the various stripline conductors. This is necessary in order to show all of the circuits in a single illustration in their proper relationships. First stripline conductor 20 is disposed either on the upper surface of dielectric sheet 18 or the lower surface of dielectric sheet 16. All other circuit elements are disposed on the lower side of the turntable portion of dielectric sheet 16 or are embedded therein. A second stripline conductor 38 comprises a first terminal portion 40, a coupling portion 42 and a second terminal portion 44. Coupling portion 42 is juxtaposed with first stripline conductor 20 and is adapted to vary a coupling distance d therebetween as turntable 30 rotates. In this case, coupling portion 42 is an arctuate strip having a radius of curvature approximately equal to the radius of turntable 30 but being eccentric therewith. Coupling portion 42 has an electrical length substantially equal to an odd number of quarter wavelengths. This structure provides smoothly variable coupling, since the degree of electromagnetic coupling between conductor 20 and coupling portion 42 is related to the coupling distance d, which varies smoothly as turntable 30 is rotated since coupling portion 42 is eccentric therewith. Many variations of this structure are possible. For instance, turntable portion 30 may be replaced by any analogous structure which allows coupling portion 42 to be pivotally mounted with respect to first transmission line conductor 20.

Since, in this particular embodiment, only signals propagating in the direction shown by the arrows associated with conductor 20 are of interest, first terminal portion 40 is terminated to prevent unwanted reflections. This is accomplished by means of a 50 ohm chip resistor 48 and a grounding eyelet 50. The signal propagating in the indicated direction on first stripline conductor 20 induces a signal on coupling portion 42 traveling toward second terminal portion 44. The signal on conductor 20 (and the primary transmission line) is substantially unperturbed. Second terminal portion 44 serves to connect coupling portion 42 to a circuit which uses the sampled signal and includes a matching stub 46 for impedance matching purposes.

While the adjusting coupling circuit described above may be used in conjunction with a large variety of circuits, the embodiment described herein is useful to sample a signal on the primary transmission line (and therefore on stripline conductor 20) with relatively little interference with the signal on the primary line, to detect the sampled signal and to provide a buffered output of the result. To accomplish this, the power detector circuit coupled to second terminal portion 44 comprises a detector diode 52, a transistor buffer 54 and an output terminal 56 coupled to output connector 34. Detector diode 52, which is coupled to second terminal portion 44, is coupled to the base terminal of transistor buffer 54 by means of a stripline conductor 58. Conductor 58 includes an RF shorting stub 60 to eliminate the RF component of the detected signal and a load resistor 62 coupled to ground 64. A bias voltage is supplied to the collector terminal of transistor buffer 54 by means of filter feedthrough connector 36 (FIGS. 1 and 2), terminal 66 and capacitor 68. The emitter terminal of transistor buffer 54 is coupled to output terminal 56 which is coupled to output connector 34. Buffer 54 is thus connected in an emitter follower configuration and operates as a buffer between the low current signal on stripline conductor 58 and the higher current signal in the output circuit. The output circuit may comprise, for instance, a coaxial cable 70 connected to output connector 34 and a load resistor 72. Many possible variations in this power detector circuit will be apparent to one skilled in the art.

The power detector apparatus described is useful to sample, for instance, a magnetron pulse in a radar system. The pulse on the primary line is minimally interfered with, the sampled pulse is demodulated, and the video signal is amplified and output for use in controlling timing sequences or otherwise. The variable coupler allows a predetermined output level to be realized with various signal levels on the primary line. The unique structure of the apparatus provides these functions in a compact package and eliminates electrical problems caused by flexible transmission line conductors.

While the present invention has been particularly shown and described with reference to a preferred embodiment thereof, it will be understood by those skilled in the art that various other modifications and changes may be made to the present invention without departing from the spirit and scope thereof.

I claim:

1. An adjustable directional coupler comprising:

a first transmission line comprising a first transmission line conductor and grounding means;

a second transmission line comprising a second transmission line conductor and grounding means, a coupling portion of said second transmission line conductor being juxtaposed with said first transmission line conductor, being pivotally mounted with respect thereto and being adapted to vary a coupling distance therebetween with a pivotal motion; and turntable means adjacent said first transmission line conductor for carrying said second transmission line conductor.

2. An adjustable directional coupler according to claim 1 wherein said second transmission line conductor further comprises:

a first terminal portion; and a second terminal portion, said coupling portion having an electrical length substantially equal to an odd number of quarter wavelengths and being between said first and second terminal portions.

3. An adjustable directional coupler according to claim 2 wherein said first terminal portion further comprises:

load means for terminating said second transmission line in a characteristic impedance.

4. An adjustable directional coupler according to claim 3 wherein said second terminal portion further comprises:

stub means for matching an impedance of said second transmission line to an impedance of a circuit connected to said second terminal portion.

5. A stripline adjustable directional coupler comprising:

a first dielectric sheet having a ground plane disposed on a first side thereof:

a second dielectric sheet having a ground plane disposed on a first side thereof, said first and second dielectric sheets having their respective second sides in contact;

a first conductor disposed on said second side of one of said first and second dielectric sheets; and a second conductor disposed on said second side of a turntable portion of said first dielectric sheet, said turntable portion being adapted to rotate with respect to the remainder of said first dielectric sheet, said first conductor being adjacent to said turntable portion and said second conductor having a coupling portion juxtaposed with said first conductor and adapted to vary a coupling distance therebetween as said turntable portion rotates.

6. A stripline adjustable directional coupler according to claim 5 wherein said second conductor further comprises:

a first terminal portion; and a second terminal portion, said coupling portion having an electrical length substantially equal to an odd number of quarter wavelengths and being between said first and second terminal portions.

7. A stripline adjustable directional coupler according to claim 6 wherein said first terminal portion further comprises:

load means for terminating said second conductor in a characteristic impedance.

8. A stripline adjustable directional coupler according to claim 6 wherein said second terminal portion further comprises:

stub means for matching an impedance of said second conductor to an impedance of a circuit coupled to said second terminal portion.

9. An adjustable power detector apparatus for connection in series with a primary transmission line comprising:

first and second connector means for connecting said power detector into said primary transmission line;

a first conductor extending between said first and second connector means;

turntable means adjacent said first conductor for rotatably carrying at least a second conductor;

a second conductor on said turnrable means, said second conductor having a coupling portion juxaposed with said first conductor and adapted to vary a coupling distance therebetween as said turntable portion rotates; and a power detector circuit on said turntable means coupled to said second conductor.

10. An adjustable power detector according to claim 9 wherein said power detector circuit comprises:

a detector diode.

11. An adjustable power detector according to claim 9 further comprising:

an output connector substantially in the center of said turntable means, said output connector being coupled to said power detector circuit.

12. An adjustable stripline power detector for connection in series with a primary transmission line comprising:

a first stripline circuit comprising first and second dielectric sheets, a first stripline conductor disposed between said dielectric sheets and first and second ground planes on said dielectric sheets;

first and second connector means for connecting said primary transmission line to said first stripline circuit;

a second stripline circuit comprising said first and second dielectric sheets, said first and second ground planes and a second stripline conductor, said second stripline conductor being located on a turntable portion of said first dielectric sheet adapted to rotate with respect to the remainder of said first dielectric sheet, said second stripline conductor having a coupling portion juxtaposed with said first stripline conductor and adapted to vary a coupling distance therebetween as said turntable portion rotates;

a power detector circuit on said turntable portion of said first dielectric sheet, said power detector circuit being coupled to said second stripline circuit; and output connector means located substantially in the center of said turntable portion for coupling said power detector circuit to an external circuit.

13. An adjustable stripline power detector according to claim 12 wherein said second stripline conductor further comprises:

a first terminal portion; and a second terminal portion, said coupling portion having an electrical length substantially equal to an odd number of quarter wavelengths and being between said first and second terminal portions.

14. An adjustable stripline power detector according to claim 13 wherein said first terminal portion further comprises:

load means for terminating said second stripline circuit in a characteristic impedance.

15. An adjustable stripline power detector according to claim 13 wherein said second terminal portion further comprises:

stub means for matching an impedance of said second stripline circuit to an impedance of said power detector circuit.

16. An adjustable stripline power detector according to claim 15 wherein said power detector circuit further comprises:

a detector diode coupled to said second terminal portion of said second stripline conductor.

17. An adjustable stripline power detector according to claim 16 wherein said power detector circuit further comprises:

buffer means coupled between said detector diode and said output connector means for buffering a signal from said detector diode.

18. An adjustable stripline power detector according to claim 17 wherein said power detector circuit further comprises:

stub means between said detector diode and said buffer means for shorting an RF component of said signal from said detector diode.

* * * * *